US011217415B2

(12) United States Patent
Santos et al.

(10) Patent No.: US 11,217,415 B2
(45) Date of Patent: Jan. 4, 2022

(54) HIGH BREAKING CAPACITY CHIP FUSE

(71) Applicant: Littelfuse, Inc., Chicago, IL (US)

(72) Inventors: Irma Valeriano Santos, Chicago, IL (US); G. Todd Dietsch, Park Ridge, IL (US)

(73) Assignee: Littelfuse, Inc., Chicago, IL (US)

( * ) Notice: Subject to any disclaimer, the term of this patent is extended or adjusted under 35 U.S.C. 154(b) by 0 days.

(21) Appl. No.: 17/023,601

(22) Filed: Sep. 17, 2020

(65) Prior Publication Data

US 2021/0090839 A1 Mar. 25, 2021

Related U.S. Application Data

(60) Provisional application No. 62/906,024, filed on Sep. 25, 2019.

(51) Int. Cl.

| | |
|---|---|
| ***H01H 85/17*** | (2006.01) |
| ***H01H 85/041*** | (2006.01) |
| ***H01H 85/06*** | (2006.01) |
| *H01H 85/165* | (2006.01) |

(52) U.S. Cl.

CPC ..... *H01H 85/17* (2013.01); *H01H 85/0411* (2013.01); *H01H 85/06* (2013.01); *H01H 85/165* (2013.01); *H01H 2085/0412* (2013.01); *H01H 2085/0414* (2013.01)

(58) Field of Classification Search

CPC .. H01H 85/0411; H01H 85/06; H01H 85/165; H01H 85/17; H01H 2085/0412; H01H 2085/0414; H01H 85/175; H01H 85/1755

See application file for complete search history.

(56) References Cited

U.S. PATENT DOCUMENTS

| | | | | | |
|---|---|---|---|---|---|
| 2,483,577 | A | * | 10/1949 | Fahnoe | H01H 85/42 337/161 |
| 4,100,523 | A | * | 7/1978 | Arikawa | H01H 85/38 337/163 |
| 4,306,213 | A | * | 12/1981 | Rose | H01R 13/68 337/297 |

(Continued)

FOREIGN PATENT DOCUMENTS

| | | | |
|---|---|---|---|
| CN | 102013368 | A | 4/2011 |
| CN | 106783449 | A | 5/2017 |
| DE | 29717120 | U1 | 11/1997 |

OTHER PUBLICATIONS

Extended European Search Report dated Feb. 9, 2021 for European Patent Appln No. 20197842.6.

*Primary Examiner* — Jacob R Crum

(74) *Attorney, Agent, or Firm* — Kacvinsky Daisak Bluni PLLC

(57) ABSTRACT

A high breaking capacity chip fuse including a bottom insulative layer, a first intermediate insulative layer, a second intermediate insulative layer, and a top insulative layer disposed in a stacked arrangement in the aforementioned order, a fusible element disposed between the first and second intermediate insulative layers and extending between electrically conductive first and second terminals at opposing longitudinal ends of the bottom insulative layer, the first intermediate insulative layer, the second intermediate insulative layer, and the top insulative layer, wherein the first and second intermediate insulative layers are formed of porous ceramic.

9 Claims, 1 Drawing Sheet

(56) References Cited

U.S. PATENT DOCUMENTS

| | | | | |
|---|---|---|---|---|
| 4,855,705 | A * | 8/1989 | Narancic | H01H 69/02 337/246 |
| 6,650,223 | B1 * | 11/2003 | Jollenbeck | H01H 85/0411 29/623 |
| 2005/0141164 | A1 * | 6/2005 | Bender | H01H 85/0047 361/104 |
| 2008/0191832 | A1 * | 8/2008 | Tsai | H01H 85/046 337/297 |
| 2014/0266564 | A1 * | 9/2014 | Enriquez | H01H 85/175 337/295 |
| 2015/0009007 | A1 * | 1/2015 | Enriquez | H01H 85/143 337/290 |
| 2019/0284096 | A1 * | 9/2019 | Hoel | C04B 35/488 |

* cited by examiner

HIGH BREAKING CAPACITY CHIP FUSE

CROSS-REFERENCES TO RELATED APPLICATIONS

This application claims the benefit of U.S. Provisional Patent Application No. 62/906,024, filed Sep. 25, 2019, which is incorporated by reference herein in its entirety.

FIELD OF THE DISCLOSURE

This disclosure relates generally to the field of circuit protection devices and relates more particularly to a chip fuse having porous inner layers adapted to absorb energy from a blown fusible element.

BACKGROUND OF THE DISCLOSURE

Chip fuses (also commonly referred to as "solid-body" fuses) typically include a fusible element extending between two conductive endcaps and sandwiched between two or more layers of dielectric material (e.g., ceramic). When the fusible element of a chip fuse is melted or is otherwise opened during an overcurrent condition it is sometimes possible for an electrical arc to propagate between the separated portions of the fusible element. The electrical arc may rapidly heat the surrounding air and ambient particulate and may cause a small explosion within the chip fuse. In some cases, the explosion may break the dielectric layers and rupture the chip fuse, potentially causing damage to surrounding components. The likelihood of rupture is generally proportional to the severity of the overcurrent condition. The maximum current that a chip fuse can arrest without rupturing is referred to as the chip fuse's "breaking capacity." It is generally desirable to maximize the breaking capacity of a chip fuse without significantly increasing the size or form factor of the chip fuse.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

A high breaking capacity chip fuse in accordance with a non-limiting embodiment of the present disclosure may include a first intermediate insulative layer, a second intermediate insulative layer, and a top insulative layer disposed in a stacked arrangement in the aforementioned order, a fusible element disposed between the first and second intermediate insulative layers and extending between electrically conductive first and second terminals at opposing longitudinal ends of the bottom insulative layer, the first intermediate insulative layer, the second intermediate insulative layer, and the top insulative layer, wherein the first and second intermediate insulative layers are formed of porous ceramic.

A method of forming a high breaking capacity chip fuse in accordance with a non-limiting embodiment of the present disclosure may include providing a bottom insulative layer, a first intermediate insulative layer, a second intermediate insulative layer, and a top insulative layer disposed in a stacked arrangement in the aforementioned order, and disposing a fusible element between the first and second intermediate insulative layers, the fusible extending between electrically conductive first and second terminals at opposing longitudinal ends of the bottom insulative layer, the first intermediate insulative layer, the second intermediate insulative layer, and the top insulative layer, wherein the first and second intermediate insulative layers are formed of porous ceramic.

BRIEF DESCRIPTION OF THE DRAWINGS

By way of example, various embodiments of the disclosed system will now be described, with reference to the accompanying drawings, wherein.

DETAILED DESCRIPTION

A high breaking capacity chip fuse in accordance with the present disclosure will now be described more fully with reference to the accompanying drawings, in which preferred embodiments of the high breaking capacity chip fuse are presented. It will be understood, however, that the high breaking capacity chip fuse described below may be embodied in many different forms and should not be construed as being limited to the embodiments set forth herein. Rather, these embodiments are provided so that this disclosure will convey certain exemplary aspects of the high breaking capacity chip fuse to those skilled in the art.

Figure 1A:
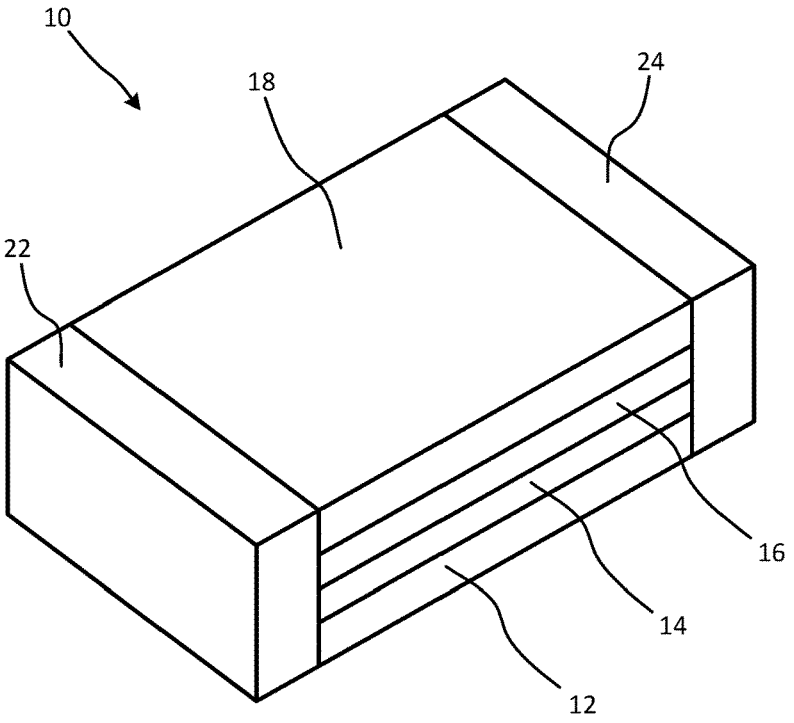
FIG. 1A is a perspective view illustrating a high breaking capacity chip fuse in accordance with an exemplary embodiment of the present disclosure.
Figure 1B:
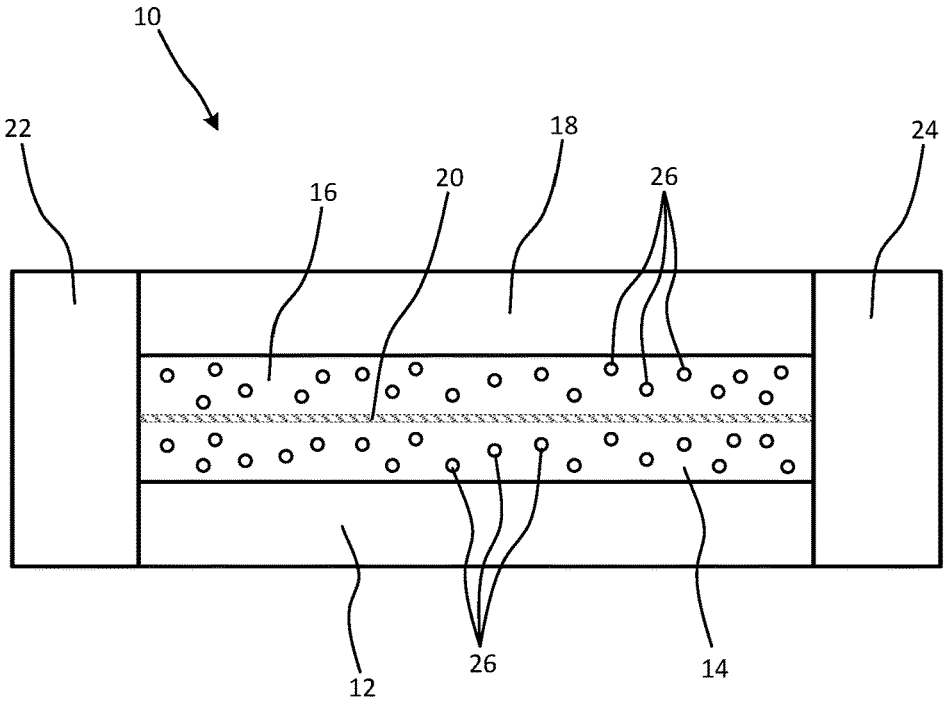
FIG. 1B is cross sectional view illustrating the high breaking capacity chip fuse shown in FIG. 1A.

Referring to FIGS. 1A and 1B, a perspective view and a cross sectional side view illustrating a high breaking capacity chip fuse 10 (hereinafter "the fuse 10") in accordance with an exemplary, non-limiting embodiment of the present disclosure are shown. The fuse 10 may include a bottom insulative layer 12, a first intermediate insulative layer 14, a second intermediate insulative layer 16, and a top insulative layer 18 disposed in a stacked arrangement in the aforementioned order. The layers 12-18 may be flatly bonded to one another, such as with epoxy or other electrically insulating adhesive or fasteners. While the fuse 10 is shown and described herein as having only two intermediate insulative layers (the first and second intermediate insulative layers 14, 16), it is contemplated that the fuse 10 may be provided with additional intermediate insulative layers without departing from the scope of the present invention. For example, the fuse 10 may be provided with a third intermediate insulative layer disposed between the bottom insulative layer 12 and the first intermediate insulative layer 14, and/or a fourth intermediate insulative layer disposed between the top insulative layer 18 and the second intermediate insulative layer 16. The present disclosure is not limited in this regard.

The fuse 10 may further include a fusible element 20 disposed between the first and second intermediate insulative layers 14, 16 (e.g., sandwiched between the first and second intermediate insulative layers 14, 16) and extending between electrically conductive first and second terminals 22, 24 at opposing longitudinal ends of the layers 12-18. The fusible element 20 may be formed of an electrically conductive material, including, but not limited to, tin or copper, and may be formed as a wire, a ribbon, a metal link, a spiral wound wire, a film, and electrically conductive core deposited on a substrate, etc. The fusible element 20 may be configured to melt and separate upon the occurrence of a predetermined fault condition in the fuse 10, such as an overcurrent condition in which an amount of current exceeding a predefined maximum current (i.e., a "rating" of the fuse 10) flows through the fusible element 20. As will be appreciated by those of ordinary skill in the art, the size, shape, configuration, and material of the fusible element 20 may all contribute to the rating of the fuse 10.

The bottom insulative layer 12 and the top insulative layer 18 of the fuse 10 may be formed of any suitable dielectric material, including, but not limited to, FR-4, glass, ceramic (e.g., low temperature co-fired ceramic), etc., and may be generally non-porous. The first and second intermediate insulative layers 14, 16 of the fuse 10 may be formed of porous ceramic (e.g., low temperature co-fired ceramic) having pluralities of hollow pores 26 formed therein. The porous ceramic of the first and second intermediate insulative layers 14, 16 may be made by mixing granules or particles of one or more fugitive materials (e.g., carbon, corn starch, etc.) into the ceramic prior to firing/curing of the ceramic. During firing/curing, the particles of fugitive material may be burned away, leaving the hollow pores 26 within the ceramic. The present disclosure is not limited in this regard.

In various embodiments, the first and second intermediate insulating layers 14, 16 may have porosities greater than the porosities of the bottom and top insulative layers 12, 18 of the fuse 10. In a particular embodiment, the first and second intermediate insulating layers 14, 16 may be 25% more porous than the bottom and top insulative layers 12, 18 of the fuse 10. In another embodiment, the first and second intermediate insulating layers 14, 16 may be 50% more porous than the bottom and top insulative layers 12, 18 of the fuse 10. In another embodiment, the first and second intermediate insulating layers 14, 16 may be 75% more porous than the bottom and top insulative layers 12, 18 of the fuse 10. In another embodiment, the first and second intermediate insulating layers 14, 16 may be 100% more porous than the bottom and top insulative layers 12, 18 of the fuse 10. The present disclosure is not limited in this regard.

During operation of the fuse 10, if an overcurrent condition causes the fusible element 20 to melt and produce an explosion, the first and second intermediate insulative layers 14, 16, which are relatively weaker and more prone to breaking than the bottom insulative layer 12 and the top insulative layer 18 due to the provision of the pores 26, may fracture and may absorb the energy of the explosion (e.g., in the manner of crumple zones in an automobile), thereby preventing much of the energy from the explosion from being communicated to the bottom insulative layer 12 and the top insulative layer 18. Additionally, the vaporized material of the melted fusible element 20 may be rapidly cleared into the pores 26 of the fractured first and second intermediate insulative layers 14, 16, thereby preventing such vaporized material from feeding and prolonging electrical arcing across separated portions of the fusible element 20. Thus, the risk of the fuse 10 being ruptured is mitigated by the fracturing of the first and second intermediate insulative layers 14, 16, and the breaking capacity of the fuse 10 may therefore be relatively greater than the breaking capacity of chip fuses that lack the porous first and second intermediate insulative layers 14, 16 of the fuse 10 of the present disclosure.

As used herein, an element or step recited in the singular and proceeded with the word "a" or "an" should be understood as not excluding plural elements or steps, unless such exclusion is explicitly recited. Furthermore, references to "one embodiment" of the present disclosure are not intended to be interpreted as excluding the existence of additional embodiments that also incorporate the recited features.

While the present disclosure makes reference to certain embodiments, numerous modifications, alterations and changes to the described embodiments are possible without departing from the sphere and scope of the present disclosure, as defined in the appended claim(s). Accordingly, it is intended that the present disclosure not be limited to the described embodiments, but that it has the full scope defined by the language of the following claims, and equivalents thereof.

The invention claimed is:

1. A high breaking capacity chip fuse comprising:

a bottom insulative layer, a first intermediate insulative layer, a second intermediate insulative layer, and a top insulative layer disposed in a stacked arrangement; and a fusible element disposed between the first and second intermediate insulative layers and extending between electrically conductive first and second terminals at opposing longitudinal ends of the bottom insulative layer, the first intermediate insulative layer, the second intermediate insulative layer, and the top insulative layer, wherein the first and second intermediate insulative layers entirely shield the bottom and top insulative layers from the fusible element;

wherein each of the first and second intermediate insulative layers is formed of a single, unitary layer of ceramic having a plurality of hollow pores encased therein.

2. The high breaking capacity chip fuse of claim 1, wherein the fusible element is one of a wire, a ribbon, a metal link, a spiral wound wire, a film, and electrically conductive core deposited on a substrate.

3. The high breaking capacity chip fuse of claim 1, wherein the first intermediate insulative layer and the second intermediate insulative layer are more porous than the bottom insulative layer and the top insulative layer.

4. The high breaking capacity chip fuse of claim 1, wherein the first intermediate insulative layer and the second intermediate insulative layer are at least 25% more porous than the bottom insulative layer and the top insulative layer.

5. The high breaking capacity chip fuse of claim 3, wherein the first intermediate insulative layer and the second intermediate insulative layer are at least 50% more porous than the bottom insulative layer and the top insulative layer.

6. The high breaking capacity chip fuse of claim 3, wherein the first intermediate insulative layer and the second intermediate insulative layer are at least 75% more porous than the bottom insulative layer and the top insulative layer.

7. The high breaking capacity chip fuse of claim 3, wherein the first intermediate insulative layer and the second intermediate insulative layer are at least 100% more porous than the bottom insulative layer and the top insulative layer.

8. The high breaking capacity chip fuse of claim 1, wherein the bottom insulative layer and the top insulative layer are formed of one of FR-4, glass, and ceramic.

9. The high breaking capacity chip fuse of claim 1, the bottom insulative layer, the first intermediate insulative layer, the second intermediate insulative layer, and the top insulative layer are flatly bonded to one another with an electrically insulating adhesive.

* * * * *